United States Patent [19]

Carter

[11] Patent Number: 4,476,955

[45] Date of Patent: Oct. 16, 1984

[54] ARTICULATED POWERED LIFT MACHINES

[76] Inventor: Jerry A. Carter, 20162 Spruce Ave., SW., Santa Ana, Calif. 92707

[21] Appl. No.: 276,307

[22] Filed: Jun. 22, 1981

[51] Int. Cl.[3] ..... E04G 1/00

[52] U.S. Cl. ..... 182/2; 212/198

[58] Field of Search ..... 182/2; 212/195, 196, 212/197, 198; 414/719

[56] References Cited

U.S. PATENT DOCUMENTS

| | | | |
|---|---|---|---|
| 1,614,979 | 1/1927 | Cole | 212/197 |
| 3,108,656 | 10/1963 | Asplundl | 182/2 |
| 3,224,528 | 12/1965 | Hubbard | 182/2 |
| 3,743,049 | 7/1973 | Leurini | 182/2 |
| 3,776,367 | 12/1973 | Grove | 182/2 |
| 4,296,833 | 10/1981 | Ashworth | 182/2 |

FOREIGN PATENT DOCUMENTS

| | | | |
|---|---|---|---|
| 1008407 | 8/1974 | Canada | 414/719 |
| 1146637 | 4/1963 | Fed. Rep. of Germany | 182/2 |
| 604852 | 7/1948 | United Kingdom | 212/197 |
| 1366635 | 9/1974 | United Kingdom | 182/2 |

*Primary Examiner*—Reinaldo P. Machado
*Assistant Examiner*—Alvin Chin-Shue
*Attorney, Agent, or Firm*—Grover A. Frater

[57] ABSTRACT

An articulated power lifting machine has a tool at the end of its working arm. The position of the sections of the working arm is sensed and made to operate a tool levelling system. That same sensor is made to move counterweights in a system which achieves simplicity by treating the need for counterweighting as equal, except for reference point of movement, as equivalent to the need for levelling. The arrangement lends itself to use with a transporter which is constructed building block style.

6 Claims, 9 Drawing Figures

ARTICULATED POWERED LIFT MACHINES

TECHNICAL FIELD

This invention relates to improvements in articulated power lifting machines. It relates particularly to a power lift which includes an articulated working arm and which can serve as a crane or as a material handler or as a personnel lift device.

BACKGROUND ART

The need to perform work at an elevated place has given rise to a substantial number of devices by which one can place a tool at an elevated position to be controlled from a remote point or, conversely, to place himself at the elevated position where the work must be done. It has become common to employ telescoping structures, articulated arms, scissors mechanisms, or combinations of those, and to mount them on a transporting vehicle. If the transporting vehicle is sufficiently lightweight, for whatever reason, counterweighting may be required. If the transporting vehicle must be made small so that it can maneuver in small space, then movement of the counterweight may be required. If the platform carrier is to be rotated relative to the transporter so that it can be extended in different directions relative to the transporter, the system for relating counterweight position to transporter position, and working height and degree of lateral extension, tends to become very complex. Further complexity is introduced into the mechanism and controls when the work station at the end of the boom or scissor must be maintained level. That is especially true when the operator rides at the end of the boom. Moreover, the requirement for safety in apparatus of this kind usually introduces even further complexity.

DISCLOSURE OF THE INVENTION

Since it matters not if safety and stability exceed safety values by more than what is required, it should be possible to trade off accuracy of counterweight control for mechanism and control simplicity, so long as performance does not fall below safe limits. To adopt that trade off approach is to abandon rigorous design engineering and to call upon innovation. This invention presents a trade off or compromise solution for the problem of counterweight positioning. That solution is integrated with work station levelling in which there is no compromise, although integration simplifies both systems.

The advantage of the invention is not confined to integrated counterweight and level control. Those control functions are provided in a way that permits use of an improved articulated and extensible boom structure.

An apparatus made according to the invention can reach to a greater height for a given carrier conveyance dimension and degree of portability than prior apparatus can reach. Thus, the invention is particularly important in applications such as warehousing where it is desirable to devote as little area as possible to aisles and maneuvering of the lift apparatus. To provide that kind of advantage is one of the primary objects of the invention.

The embodiment selected for illustration in the drawings is a machine five feet wide. It can operate in a six foot wide aisle. Its standing height is thirty feet, and it has a seventeen foot reach at the eleven foot clearance level. Those dimensions describe but one example of the invention, of course, but they add perspective to the assertion that machines made according to the invention rank with those of best capability.

The machine is shown in the drawings with a platform bucket mounted on the end of its upper arm. It is fitted with controls that permit a workman in the bucket to manipulate the machine. A number of accessories, including a crane, a fork, and special material handling pincers, can be substituted for the platform bucket. Further, the apparatus is mounted upon a turret, in the preferred embodiment, and the turret is mounted upon a four-wheeled carrier. The carrier may have a width approaching the width of the base of the material handling machine, in this case five feet.

These several features are possible, and they are possible at minimum cost, because of the way that the boom is articulated, because of the inclusion of a movable counterweight, and because of the scheme used for deriving signals for counterweight movement and for platform or tool levelling. The boom is divided into two arms, the upper one of which is extensible in the preferred embodiment. The lower end of the lower arm is pivotally connected by what is called the lower pivot to the turret at one end of the turret. When the boom is fully retracted and lowered, the lower arm extends horizontally back across the turret. The upper arm is pivoted at its lower end to the upper end of the lower arm. In lowered position, it extends horizontally atop the lower arm and back along that arm past its lower end. Pivoting the lower arm and extending the upper arm while the upper arm remains horizontal results in horizontal reaching. Pivoting the upper arm and extending it, and pivoting the lower arm and extending it, all results in vertical reaching. The particular unit shown in the drawing does not include an extensible lower boom, although inclusion of that feature is possible within the invention.

The counterweight is divided into two sections in the preferred embodiment, and the sections are mounted on the turret so that one lies on either side of the lower arm of the boom. The sections are movable together horizontally, toward and away from the lower pivot of the boom. They occupy a reference position when the boom is fully lowered and retracted. In the preferred embodiment, the center of gravity of each of the weights lies in a verticle plane that includes, or is quite near to, the turret axis. Because of the way that the boom is articulated, the reference position can and does lie at one end of the range of counterweight movement. That is a compromise that sometimes provides less than perfect counterweighting, but it simplifies the mechanism and reduces cost without sacrificing safety.

Because of the articulation scheme, only a limited range of counterweight positions is required. The counterweights are moved in response to the degree of pivoting of the two arms, but the degree of displacement of the counterweights, relative to the lower pivot, depends upon the direction in which the center of gravity is moved by the combined pivoting of the two arms.

One of the features of the invention is that it provides a relatively simple system for measuring the combined change in arm position and for accomplishing levelling and counterweight positioning. To accomplish those tasks in a simple, relatively inexpensive and reliable fashion is another of the objects of the invention.

In one view of the preferred form of the invention, it can be said to include a base structure, and a boom overlying the base structure comprising first and second arms, the inner end of the first arm having pivotal connection to the base structure on a first generally horizontal pivot axis, and the second arm overlying the first arm and having pivotal connection at its inner end to the outer end of the first arm on a second and generally horizontal pivot axis. In that view, the invention further includes a means for pivoting the second arm relative to the first arm independently of the movement of the first arm such that the outer end of the second arm is moved arcuately about the second pivot axis. The organization further includes a means for pivoting the first arm relative to the base such that the outer end of said first arm and said second arm are moved arcuately about said first pivot axis.

A bucket carried at the outer end of the second arm and a counterweight in the base are moved so that the bucket is levelled and counterweighted for every combination of arm angles. The combined position of the arms is measured relative to a reference position, and bucket leveling and counterweight positioning is made a function of that measurement.

That latter feature of the invention is described as algebraically adding quantities proportional to the amounts, if any, by which the arm angles vary from respectively associated angles and moving the counterweight and tilting the work element, if any, at an amount proportional to the algebraic sum so found.

In preferred form, the reference position is chosen as one in which the end of the boom, or the work element at the end of the boom, is extended as far from the base as possible. The work element is normally made level in that boom position, and the counterweight is moved to the extreme end of its travel.

Another feature of the invention lies in the way that the arms and counterweights are arranged relative to the wheeled support structure.

DESCRIPTION OF THE PREFERRED EMBODIMENT

Figure 1:
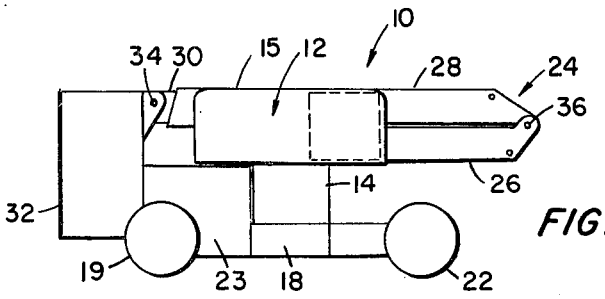
FIG. 1 is a generally schematic showing of a vehicle mounted lift, the boom of which is shown in its fully lowered condition.

In FIG. 1, the numeral 10 designates the lift structure generally. It comprises a turret and counterweight assembly 12. The turret is designated 14 and that half of the counterweight structure which is shown in FIG. 1 is identified by the reference numeral 15. The other half of the counterweight structure is visible from the other side and may be seen in some of the other figures where it is identified by the reference numeral 16. The turret is mounted on the transport structure which includes a support 18 for the base, forward wheels 19 and 20, and rear wheels 21 and 22 (see FIG. 2). The transport structure includes a driving motor and the hydraulic pumps and motors and reservoirs that form part of the system for developing hydraulic power for moving the arms and the turret. That apparatus is housed in the enclosure 23.

The boom is generally designated 24. It comprises a lower arm 26 and an upper arm 28. The upper arm includes a telescopic extension 30. The work tool, in this case a bucket 32, is pivotally mounted at the end of the telescopic section 30. The telescopic extension 30 and the bucket 32 are interconnected by a pivot pin at the pivot axis 34. The lower and upper arms are interconnected by a pivot pin that lies on the pivot axis 36. The lower arm has pivotal connection to the counterweight and boom structure 12 by a pivot pin 38 which may be seen in FIGS. 7 and 9 at the left, but is hidden in all of the other figures, except FIG. 6 where it is represented schematically. For convenience, the respective pivot pins and their pivot axes are referred to by the same reference numeral.

Figure 2:
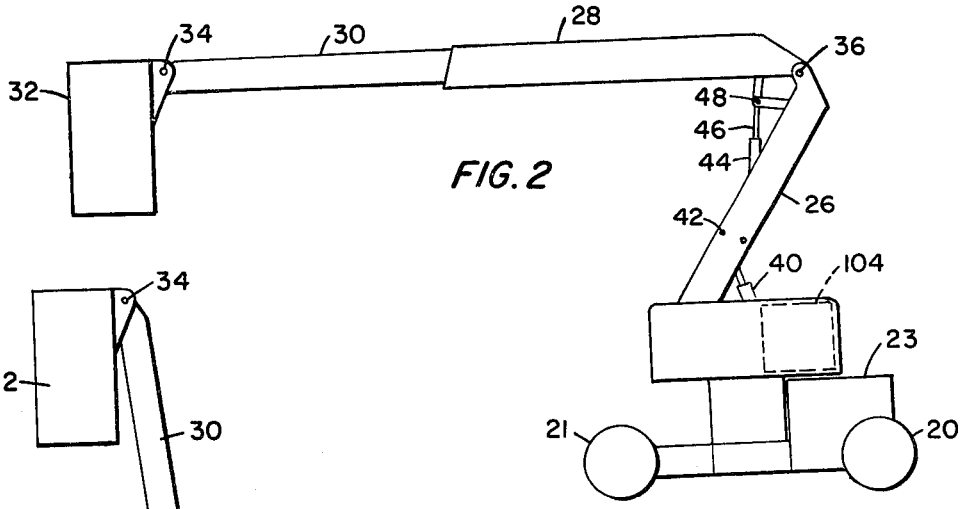
FIG. 2 is a schematic view in elevation of the lift structure of FIG. 1 shown from its opposite side and with the lower arm raised and its upper arm extended.
Figure 3:
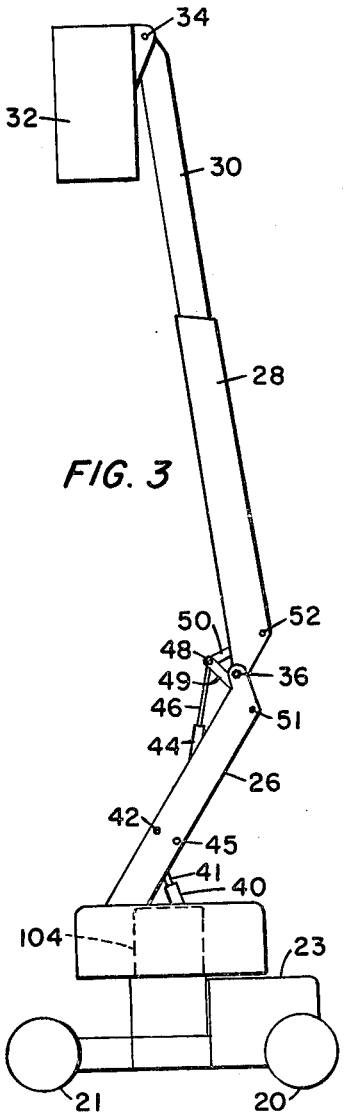
FIG. 3 is a schematic view of the lift structure shown in FIGS. 1 and 2 as seen with its arms fully raised and extended.

The lower arm 26 is pivoted relative to the counterweight and turret structure 12 by hydraulic cylinder and piston assembly 40 which is visible in FIGS. 2 and 3. The position of the cylinder is shown by phantom lines in FIGS. 7 and 9 where the lines are identified by the reference numeral 40. The lower end of the piston has pivotal connection to the turret. The piston rod 41 has pivotal connection to the lower arm at a pivot point 42.

The upper arm is pivoted about pivot axis and pivot pin 36 relative to the lower arm 26 by an hydraulic piston and cylinder assembly 44. The cylinder has pivotal connection with the lower arm at a point 45 visible in FIG. 3 of the drawing. The fact that the cylinder is free to pivot is obvious from a comparison of FIGS. 2 and 3. The piston rod 46 extends from the cylinder to a pivot point 48 which is common to that piston rod and to two scissors arms 49 and 50. Arm 49 has pivotal connection at its outer end to the lower arm 26 at a pivot axis 51 and the outer end of arm 50 has pivotal connection to upper arm 28 at a pivot axis 52. The pivot axis 51 and the pivot axis 52 are removed from the pivot axis 36 and lie on opposite sides of axis 36 to the end that the change in the degree of extension of rod 46 is multiplied. The upper and lower arms can be moved from a position in which arm 28 lies parallel to and atop of arm 26 to one in which the upper arm has been moved through an angle approaching 180 degrees.

The arms and bucket are shown in FIG. 1 to have the position that they would ordinarily occupy when the apparatus was being moved from one place to another or was idle. It will be apparent from an examination of FIG. 3 that the overall length of the unit can be reduced to a length no greater than the distance spanned by its wheels by elevating the arms. FIG. 2 illustrates how the apparatus is used to reach horizontally and FIG. 3 illustrates how it is used to reach vertically.

It will be apparent that arm 28 could be lowered in FIG. 2 without changing the position of arm 26 to move the bucket 32 to a point below the pivot axis 36. Indeed, it can be lowered all the way to ground level, the level on which the wheels 19, 20, 21 and 22 are resting. If that was done, and if the bucket 32 was moved to the level position which it is shown to occupy in all of the drawings, then the angle between the vertical axis through the bucket 32 to the axis of upper arm 28, would be less than 90 degrees. In FIG. 1, the angle between the vertical axis through bucket 32 and the axis of upper arm 28 is substantially 90 degrees. In FIG. 3, that angle, the angle measured from the vertical axis through bucket 32 to the axis of upper arm 28 measured over the top of the pivot 34, would exceed 90 degrees and, indeed, it approaches 180 degrees.

Bucket 32 is said to be level when its central axis is vertical as shown in FIGS. 1, 2, 3, 4 and 6 of the drawings. Means are included in the structure for maintaining the bucket level automatically. The manner in which that is accomplished is illustrated schematically, and partly diagrammatically, in FIG. 6 where the upper arm 28 and its telescopic extension 30 are represented by the arm 28*a*. A double acting, hydraulic cylinder and piston assembly 60 is mounted at the outer end of that arm 28*a*, axially on the extension 30. It is fixed to arm 28*a*. Its piston, not visible in the drawings, is connected to a chain 61 which extends from one side of the piston over an idler pulley 62 and over a sprocket 64 which is fixed to an arm 65. The arm is fixed to the side of bucket 32. The sprocket is mounted on the pivot axis and pivot pin 34. When the piston moves, the chain moves causing the sprocket 64 and the arm 65 and the bucket 32 to rotate about pivot 34. The piston within the piston and cylinder assembly 60 is moved by hydraulic fluid applied by lines emanating from the assembly 60.

Figure 6:
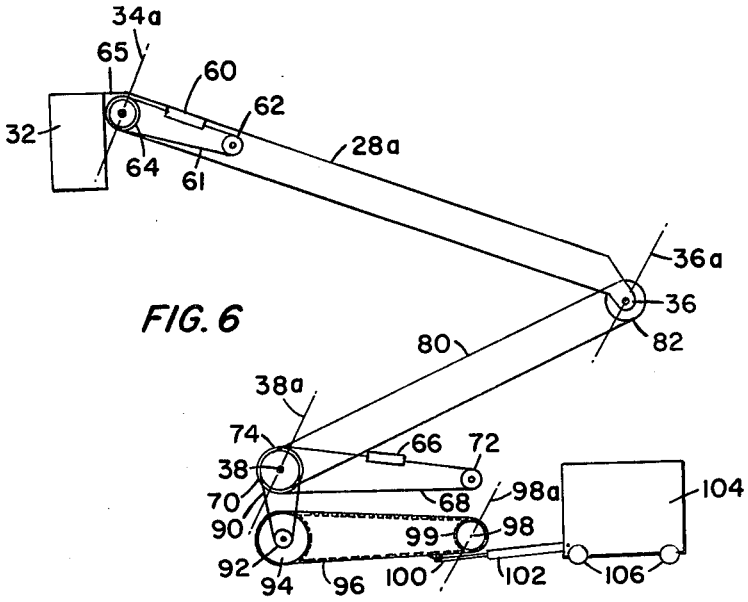
FIG. 6 is a schematic diagram of the elements in the counterweight positioning and levelling system of the machine shown in FIGS. 1 through 4.
Figure 7:
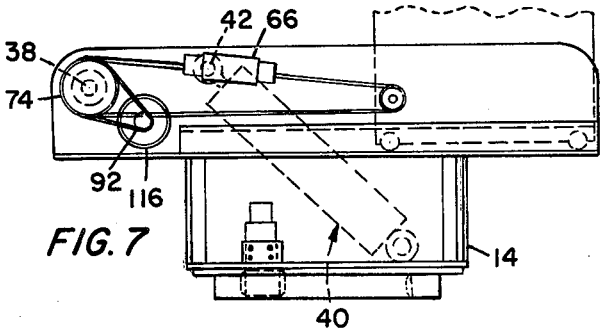
FIG. 7 is a cross-sectional view taken through a portion of the turret structure of the apparatus of FIGS. 1 through 4, some of the parts being shown in phantom lines to illustrate where they are positioned in the assembled structure.
Figure 9:
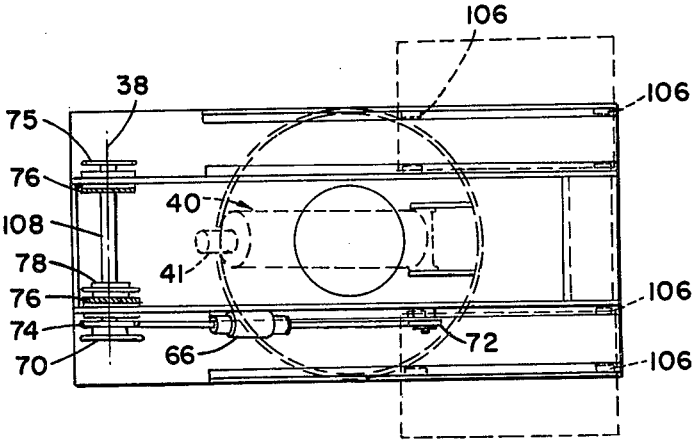
FIG. 9 is a top view of the structure shown in FIG. 7, some of the elements being shown in phantom lines to indicate where they are positioned in the assembled mechanism.

Those lines are connected to the lines which originate at a double acting piston and cylinder assembly 66 which may be seen in FIGS. 6, 7 and 9.

As indicated in FIG. 6, the cylinder of assembly 66 is fixed, and it is fixed to the counterweight and turret structure. The chain 68 extends around a pair of sprockets 72 and 74. The sprocket 72 is an idler fixed to the counterweight and turret assembly 12. Sprocket 74 is fixed to shaft 108 shown in FIG. 9. Its axis is coincident with the hollow pivot pins and pivot axis 38 of the lower arm. One is shown in phantom lines in FIG. 7.

In FIG. 9, at the left end of the figure, the members 76 form part of the lower arm 26. The sprocket 74 rotates about axis 38. A sprocket 78 is also fixed to the shaft 108 on which sprocket 74, sprocket 75 and sprocket 70 are fixed. A chain or cable 80, in FIG. 6, extends around the sprocket 78 (see FIG. 9) at the lower end of arm 26. The arm itself is not shown in FIG. 6. The chain 80 also extends around a sprocket 82 which has an axis coincident with the pivot pin and pivotal axis 36. Sprocket 82 is fixed to the arm 28*a* which represents upper arm 28 and extension 30 in the other figures.

Continuing in FIG. 6, the end sprockets 70, 74 and 75 are driven by sprocket 78. The chain 90 extends around sprocket 70 and around sprocket 92 so that the sprocket 92 is driven when sprocket 70 is driven. The sprocket 92 is fixed to a sprocket 94 on their common axis. An endless chain 96 extends over the sprocket 94 and is driven by it. Chain 96 also extends over an idler sprocket 99 which rotates on pivot pin 98. One of the links of the chain is connected by a bracket 100 to a drive rod 102 the other end of which connects to a counterweight 104. The counterweight is shown to be mounted on wheels 106. Those wheels correspond to the wheels 106 shown in dashed lines in FIG. 9.

Figure 8:
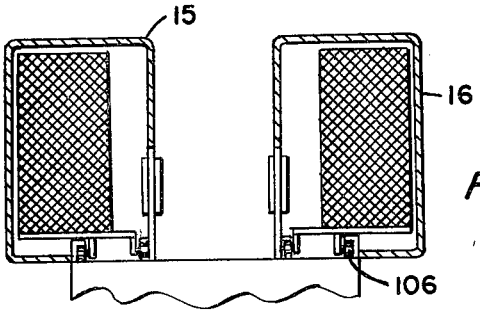
FIG. 8 is a cross-sectional view taken through the upper portion of the counterweight and turret structure showing how the counterweight is associated with the turret.

As shown in FIG. 6, all three of the chains 80, 68 and 90 extend over sprockets which rotate about axis 38. There is a sprocket at each end of shaft 108. One of them is identified by the reference numeral 70, and the other by the reference numeral 75. A chain, corresponding to chain 90 in FIG. 6, extends over each of the sprockets 70 and 75. Each of those chains also extends over a sprocket corresponding to sprocket 92 in FIG. 6. Sprocket 92 is fixed to chain sprocket 116 which is visible in FIG. 7 and corresponds to sprocket 94 of FIG. 6. The construction on the opposite side of the shaft 108 is the same. A chain corresponding to chain 90 extends over each of sprockets 116 and its counterpart forwardly to a respectively associated idler pulley. The chains and the idlers are not visible in FIGS. 7 or 9, but they are represented by chain 96 and idler 98 in FIG. 6. FIG. 6 shows only one counterweight and one connecting arm 102 which extends from the counterweight to the connector 100. In the actual machine, there are two chains corresponding to chains 96 of FIG. 6 and there is a connector similar to connector 100 which is associated with each of them. There are two counterweights and each is connected to a respectively associated one of those connectors through a drive rod similar to drive rod 102 of FIG. 6. That structure has been omitted from FIG. 9 for the sake of clarity, but the two counterweights may be seen in FIG. 8.

To facilitate understanding of the invention, a center line has been drawn through each of several of the pivot pins and pivot axes, in FIG. 6. More particularly, center line 34*a* has been drawn through pivot axis 34. Center line 36*a* has been drawn through pivot axis 36. Center line 38*a* extends through pivot axis 38, and center line 98*a* has been drawn through pivot axis 98. In each case, the center line is drawn through its respectively associated pivot axis. The four center lines have been drawn parallel to one another. They have been drawn perpendicular to the longitudinal center line of upper arm 28*a*. Let it be assumed that center line 34*a* rotates with sprocket 64 which is fixed to bucket 32, and that center line 36*a* rotates with sprocket 82 which is fixed to arm 28*a*. Let it be assumed that center line 38*a* rotates with sprocket 74 which floats on axis 38. Finally, let it be assumed that center line 98*a* rotates with rotation of the sprocket 99 as a multiple of the rotation of sprockets 70, 92 and 94. There are only two arm rotating hydraulic cylinder and piston assemblies. One of them is numbered 40 and it rotates arm 26. Arm 28, being fixed to 26, rotates with it. The other assembly is numbered 44 and it rotates arm 28 relative to arm 26.

Returning to FIG. 6, if arm 28*a* is rotated about pivot axis 36 on a clockwise direction, then the sprocket 82 will rotate in clockwise direction and the center line 36*a* will rotate in a clockwise direction. Sprocket 74 rotates freely on the pivot axis 38 and it rotates if the chain 80 rotates. If sprocket 82 rotates clockwise, the chain 80 will be moved to cause rotation of sprocket 74 in clockwise direction so that the center line 38*a* will move clockwise and remain parallel with the center line 36*a*. Sprocket 74 having been moved clockwise, sprocket 70 is driven in a clockwise direction. Sprocket 70, acting through chain 90 and sprocket 92 will drive sprockets 94 and 99 in a clockwise direction. Chain 68 having moved, hydraulic fluid from double acting cylinder and piston unit 66 is applied to the double acting hydraulic cylinder and piston arrangement 60 such that chain 61 is driven in a counterclockwise direction to drive sprocket 64 and center line 34*a* in a counterclockwise direction.

Next, let it be assumed that the piston and cylinder assembly 44 is not actuated whereby the angle between the lower arm 26 and the upper arm represented by arm 28*a* remains constant. However, if the piston rod of cylinder and piston assembly 40 is extended, arm 26*a* and arm 28*a* will be rotated together in a counterclockwise direction. Since sprocket 82 is fixed to arm 28*a*, rotation of the two arms about pin 38*a* will result in rotation of sprocket 74 relative to the pivot pin 38. That rotation of sprocket 74 is in a counterclockwise direction. Movement of chain 68 is in a counterclockwise direction. Rotation of sprocket 70 and chain 90 and sprocket 92 and sprocket 94 and chain 96 is in the counterclockwise direction. As a consequence, sprocket 99 rotates in a counterclockwise direction. Similarly, the center line 34*a* rotates in the clockwise direction because, when chain 68 rotates counterclockwise, chain 61 rotates in a clockwise direction.

Summarizing, center lines 36*a* and 38*a* always turn together and remain parallel. When they move in a clockwise direction, the center through arm 28*a* moves clockwise, making a greater angle with the horizontal. The bucket 32 must move counterclockwise about its pivot 34 to remain level. Thus, when the center lines 36*a* and 38*a* turn clockwise, the center line 34*a* must turn counterclockwise. Conversely, when center lines 36*a* and 38*a* turn counterclockwise, the effect is to decrease the angle that the arm 28*a* makes with the horizontal and the center line 34*a* must move in a clockwise direction to maintain the bucket level. The degree of displacement of chain 68, and therefore the degree of displacement of the piston of assembly 66, is equal to the algebraic sum of the angular movements of arms 26 and 28. The displacement of the cylinder in assembly 60, and thus, the displacement of chain 61 is equal and opposite to the displacement of chain 68. As a consequence, the rotation of the bucket relative to arm 28 (28*a* in FIG. 6) is equal and opposite to the angular displacement of arm 28 as a result of the combined action of cylinder and piston assemblies 40 and 44.

Maximum counterweighting is required when the lower arm has been rotated in maximum degree and the arm 28 is horizontal. That is approximately the condition shown in FIG. 2. In that circumstance, the link 100 in FIG. 6 should be at the point at which the counterweight 104 has been moved to the right in maximum degree. That condition will prevail if the link 100 is at the right, midway around the sprocket 99. Returning to FIG. 2, if the boom 28 is lowered without changing the position of lower arm 26, the need for counterweighting is reduced. Lowering of the arm 28 will result in a rotation of chain 96 in FIG. 6 in the counterclockwise direction. As a consequence, the link 100 will be rotated around to the top side of the chain loop and the counterweight 104 will be moved to the left in small degree to diminish the amount of counterweighting.

On the other hand, if, instead of being lowered, the arm 28 is raised, while arm 26 remains raised to maximum degree, then the arm 28 will move upward toward the position shown in FIG. 3. It will be apparent that in that position, no counterweighting is required. Analysis of FIG. 6 will show that a raising of arm 28 from a position shown in FIG. 2 will result in clockwise motion of the chain 96. That will result in the counterweight 104 being pulled back to the left from the position in which it is shown in dotted lines in FIGS. 1 and 2 to the position in which it is shown in dotted lines in FIG. 3.

It will be apparent that there is a relationship between counterweight movement and bucket tilting. To examine that relationship, it is convenient to start with FIG. 2 in which the arm 26 is fully raised by piston and cylinder assembly 40 and the arm 28 is maintained horizontal by piston and cylinder assembly 44. The bucket 32 is level with its axis vertical. Downward pivoting of arm 28 requires that the counterweight be moved to the left and it requires that the bucket be tilted so that it moves clockwise around its pivot pin 34. On the other hand, raising the arm 28 by rotation around its pivot pin 36 would require a re-levelling of the bucket 32 by counterclockwise rotation around its pivot 34. If the arm 26 is lowered about its pivot without a rotation of arm 28 about its pivot point 36, then the bucket 32 will have to be levelled by rotating it counterclockwise about its pivot 34. It will be apparent that a lowering of arm 26 without changing the angle between arms 26 and 28 will result in the bucket 32 being moved back toward the position in which it is extended less far from the base, and in that circumstance, less counterweighting is required and the counterweight should be, and is, moved to the left. It will be apparent that any motion of the arms which necessitates the bucket to move closer to the center of the base should be accompanied by movement of the counterweight to the left, toward the center of the base. Conversely, any combined motion of the two arms that results in a requirement that the bucket be moved away from the center of the base should be accompanied by movement of the counterweight to the right, away from the center of the base. It is because of that that the counterweight structure can be driven by the elements that sense arm motion that tends to move the bucket from a level condition and which accomplishes the re-levelling.

The two sprockets 82 and 74 are interconnected so that their motion is added algebraically in the motion of chain 68. That motion is inverted and reproduced in motion of chain 61. The bucket, being driven by a motion of chain 61, remains level. The reference point for levelling system operation is reached when arm 28 is horizontal. Any degree of operation of piston and cylinder assemblies 40 and 44 which results in the arm 28 being horizontal brings the levelling system to that reference position. The reference position for counterweight movement is reached when the arm 28 is horizontal and the piston and cylinder assembly 40 has been fully actuated to pivot arm 26 in maximum degree. Beyond that counterweight movement corresponds to levelling movement.

Figure 5:
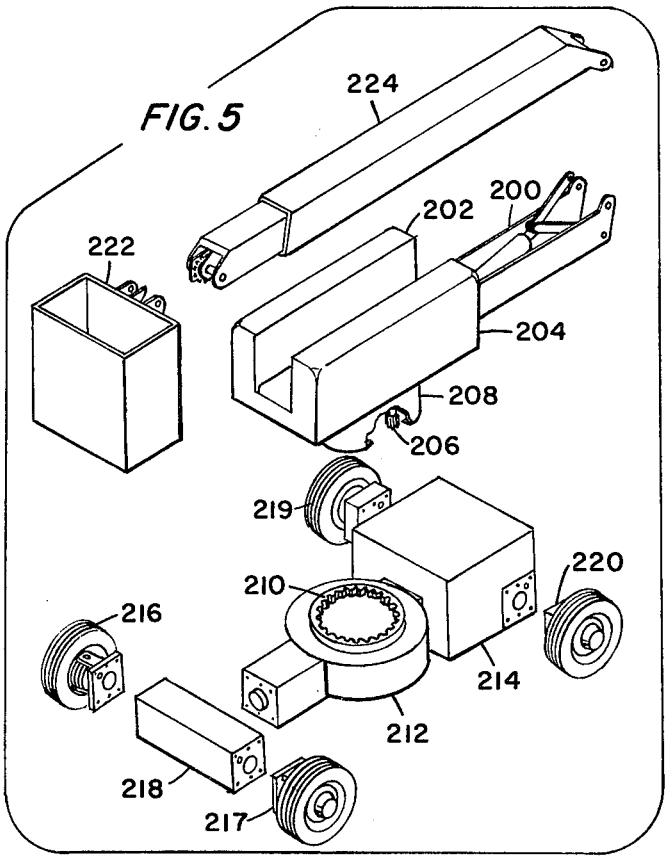
FIG. 5 is a schematic, exploded view of the lift structure, showing how it is constructed.
Figure 4:
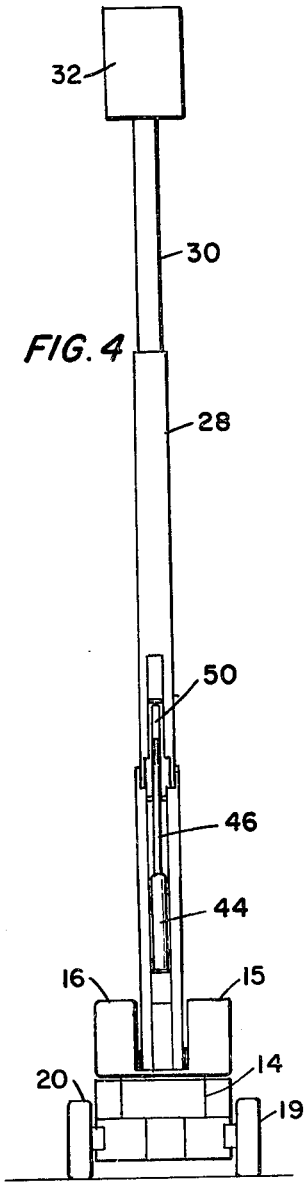
FIG. 4 is a view in front elevation of the machine as it is shown in FIG. 3.

One of the advantages of the combined structures for levelling, for arm articulation, and for counterweight movement, is that these structures lend themselves to mounting on a turret and a preferred system for mounting a turret on the base structure is illustrated in FIG. 5. The elements of FIG. 5 are like those of the other figures, but they have been drawn in simplified schematic form. In FIG. 5, the lower part of a boom 200 is pivotally mounted upon a counterweight housing. That housing is divided into two sections, 202 and 204, which straddle the lower end of the boom 200. Above are the bucket 222 and the upper boom 224. The turret consists of two relatively rotatable rings one of which is captured and rotatable inside of the other. A drive gear 206, carried by the turret ring 208, drives against the fixed ring gear 210 which is carried by the section 212 of the base. The other section 214 of the base houses the transport drive motor and the hydraulic pressure generating system. Wheel modules and axes 216, 217, 218, 219 and 220, are arranged for attachment to fittings at the forward and the rear of the base unit. Showing these elements in the exploded view of FIG. 5 makes it readily apparent that the lift may be constructed building block style. As a consequence of that, a substantial number of different wheel arrangements may be employed and the task of constructing a unit with wider wheel base is easily accomplished for those situations in which the ultimate use permits the drive unit to be longer or wider.

Although I have shown and described certain specific embodiments of my invention, I am fully aware that many modifications thereof are possible. My invention, therefore, is not to be restricted except insofar as is necessitated by the prior art.

I claim:

1. In an articulated lift, in combination:

a base structure;

a boom overlying said base structure and comprising first and second arms, the inner end of said first arm having pivotal connection to the base structure on a first generally horizontal pivot axis, said second arm overlying said first arm and having pivotal connection at its inner end to the outer end of said first arm on a second, generally horizontal pivot axis;

means for pivoting said second arm relative to said first arm independently of movement of said first arm such that the outer end of said second arm is moved arcuately about said second pivot axis;

means for pivoting said first arm relative to said base such that the outer end of said first arm and said second arm are moved arcuately about said first pivot axis;

summing means for finding the algebraic sum of the rotation of said first and second arm about said first pivot axis relative to said base and rotation of said second arm about said second axis relative to said first arm;

counterweight means in the form of a counterweight carried by said base and movable toward and away from said first pivot axis; and means for altering the distance from said counterweight to said first pivot axis as a function of said algebraic sum in response to changes in said algebraic sum.

2. The invention defined in claim 1 in which said summing means comprises a rotatable element rotatable about said first pivot axis, first element rotating means for causing said rotatable element to be rotationally displaced in one direction in a degree proportional to rotational displacement of said second arm relative to said first arm, said summing means further comprising a second rotatable element rotating means for rotationally displacing said rotatable element in the opposite direction in a degree proportional to rotational displacement of said first arm about said first pivot axis relative to said base.

3. The invention defined in claim 2 in which said means for moving said counterweight is responsive to the relative degree of rotation of said first and said second element rotating means.

4. The invention defined in claim 1 which further comprises a work element carried rotatably at the outer end of said second arm and levelling means for maintaining said work element level in response to rotation of said arm;

said levelling means comprising a first hydraulic cylinder and piston assembly carried by said second arm and means for rotating said work element in response to displacement of the piston of said first assembly;

a second hydraulic cylinder and piston assembly carried by said base and means for displacing its piston in a degree proportional to the rotational displacement of said whell; and means in the form of an hydraulic system for causing displacement of the piston of said first assembly in proportion to displacement of the piston of said second assembly.

5. In an articulated lift, in combination:

a base structure;

a boom overlying said base structure and comprising first and second arms, the inner end of said first arm having pivotal connection to the base structure on a first generally horizontal pivot axis, said second arm overlying said first arm and having pivotal connection at its inner end to the outer end of said first arm on a second, generally horizontal pivot axis;

means for pivoting said second arm relative to said first arm independently of movement of said first arm such that the outer end of said second arm is moved arcuately about said second pivot axis;

means for pivoting said first arm relative to said base such that the outer end of said first arm and said second arm are moved arcuately about said first pivot axis;

a transport means for transporting said base;

said base being mounted upon said transport means and rotatable relative to said transport means about a generally vertical axis; and further comprising a work element carried by said outer end of said second arm on a third pivotal axis and being rotationally displaceable about said third axis;

a counterweight carried by said base and movable in a plane parallel to the plane containing said arms in a direction to increase and decrease its distance from said first pivot axis;

said work element occupying a reference rotational position, and said counterweight occupying a reference position relative to said first pivot axis, when said first and second arms occupy a reference rotational position characterized in that said arms are lowered fully relative to said base;

means for rotationally displacing said work element from said reference position in a degree corresponding to the difference in the rotational positions of said first arm relative to said base and said second arm relative to said first arm; and means for displacing said counterweight from its reference position in a degree corresponding to the degree of rotation of said work element from its reference position.

6. The invention defined in claim 5 in which said counterweight is displaced in like direction from its reference position in a degree proportional to the rotational displacement of said work element from its reference position without regard to the direction of rotation from its reference position of said work element.

* * * * *